US010738556B2

(12) United States Patent
Guidry et al.

(10) Patent No.: US 10,738,556 B2
(45) Date of Patent: Aug. 11, 2020

(54) OPEN/CLOSE OUTLET INTERNAL HYDRAULIC DEVICE

(71) Applicant: Cameron International Corporation, Houston, TX (US)

(72) Inventors: Kirk Guidry, Cypress, TX (US); Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 140 days.

(21) Appl. No.: 15/985,589

(22) Filed: May 21, 2018

(65) Prior Publication Data

US 2018/0371861 A1 Dec. 27, 2018

Related U.S. Application Data

(63) Continuation of application No. 13/000,359, filed as application No. PCT/US2009/050193 on Jul. 10, 2009, now Pat. No. 9,976,376.

(60) Provisional application No. 61/085,403, filed on Jul. 31, 2008.

(51) Int. Cl.
*E21B 33/068* (2006.01)
*E21B 43/26* (2006.01)

(52) U.S. Cl.
CPC ..... *E21B 33/068* (2013.01); *E21B 43/26* (2013.01)

(58) Field of Classification Search
None
See application file for complete search history.

(56) References Cited

U.S. PATENT DOCUMENTS

| | | | |
|---|---|---|---|
| 4,381,868 | A | 5/1983 | Croy et al. |
| 4,667,986 | A | 5/1987 | Johnson et al. |
| 7,069,987 | B2 | 7/2006 | Kwasniekwski et al. |
| 2005/0034870 | A1* | 2/2005 | Buckle ..... E21B 33/038 166/368 |
| 2006/0108119 | A1 | 5/2006 | Bailey et al. |
| 2007/0079990 | A1 | 4/2007 | Borak |
| 2009/0090515 | A1 | 4/2009 | Chan et al. |
| 2010/0051261 | A1 | 3/2010 | Koleilat et al. |

OTHER PUBLICATIONS

PCT Search Report and Written Opinion for PCT/US2009/050193 dated Feb. 3, 2010; 10 pages.

* cited by examiner

*Primary Examiner* — D. Andrews
(74) *Attorney, Agent, or Firm* — Fletcher Yoder, P.C.

(57) ABSTRACT

A fluid-driven adapter for a mineral extraction system is provided. The adapter includes a sleeve (e.g., annular piston) that engages a mandrel disposed in a wellhead component and moves in an axial direction in response to fluid pressure. The adapter moves the mandrel between a first position and a second position to open or close passages in the wellhead component. The adapter includes a lock ring that moves in response to fluid pressure and that locks the adapter to a wellhead assembly to prevent axial movement of the adapter. Methods of operation are also provided.

20 Claims, 10 Drawing Sheets

FIG. 6
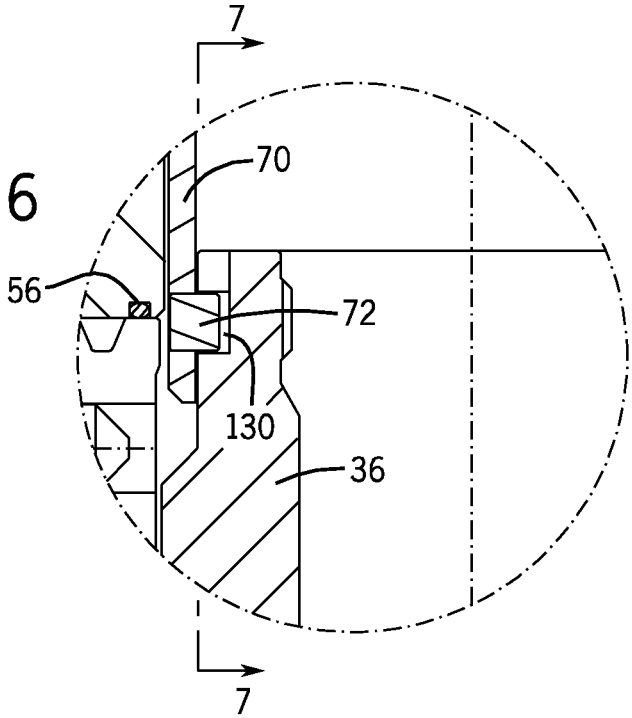
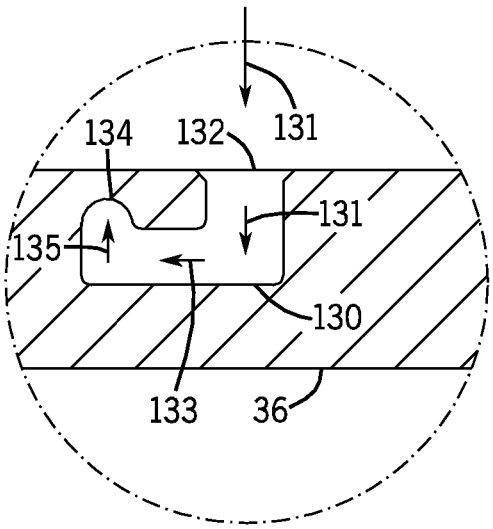
FIG. 7

OPEN/CLOSE OUTLET INTERNAL HYDRAULIC DEVICE

CROSS-REFERENCE TO RELATED APPLICATION

This application is a continuation application of U.S. application Ser. No. 13/000,359 entitled "Open/Close Outlet Internal Hydraulic Device," filed on Dec. 20, 2010, which claims priority to and benefit of PCT Patent Application No. PCT/US2009/050193, entitled "Open/Close Outlet Internal Hydraulic Device," filed Jul. 10, 2009, which is herein incorporated by reference in its entirety, and which claims priority to and benefit of U.S. Provisional Patent Application No. 61/085,403, entitled "Open/Close Outlet Internal Hydraulic Device", filed on Jul. 31, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations. Additionally, such wellhead assemblies may also include components, such as an isolating mandrel ("isolation sleeve" or "frac mandrel") and/or fracturing tree, to facilitate a fracturing process.

Resources such as oil and natural gas are generally extracted from fissures or other cavities formed in various subterranean rock formations or strata. A fracturing process (i.e., "frac" process) may be used to create one or more man-made fractures in a rock formation, such that such that a connection can be made with a number of these pre-existing fissures and cavities. In this manner, the fracturing process enables oil, gas, or the like to flow from multiple pre-existing fissures and cavities to the well via the man-made fractures. Such fracturing processes typically include injecting a fluid into the well to form the man-made fractures.

A frac mandrel is often utilized in such cases to isolate one or more lower-rated components from the fracturing pressure. The frac mandrel is typically inserted within a bore of the wellhead assembly and includes a body having a fluid passageway, such that the body isolates the lower-rated components from the pressure of the fracturing fluid injected into the well via the fluid passageway. Once the fracturing process is completed, the frac mandrel and other fracturing components may be removed from the wellhead assembly, and additional production components, such as a "Christmas tree," may be coupled to the assembly.

These "frac" wells may include relatively high pressures, such that the pressure in the well may become too high to allow further pumping of the fracturing fluid into the well. To continue pumping fracturing fluid into the well, it may be desirable to choke off the pressure, lowering the pressure in the well.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 6 is a close-up view of a section of the hydraulic adapter of FIGS. 2-5 along line 6-6 in accordance with an embodiment of the present invention;

FIG. 7 is a cross-section of FIG. 6 taken along line 7-7 in accordance with an embodiment of the present invention;

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present technique include a system and method that addresses one or more of the above-mentioned challenges of relieving pressure during operation of fracturing process in a mineral extraction system. As explained in greater detail below, the disclosed embodiments include an adapter having a hydraulically activated sleeve and a hydraulically activated internal lock ring. The sleeve may engage a mandrel (e.g., a frac mandrel) or other component in a wellhead assembly, and provide for hydraulic movement of the mandrel. The lock ring may be activated to secure the adapter to the wellhead assembly, locking the adapter and the mandrel to prevent undesired axial movement. In other embodiments, an adapter may include a hydraulically activated sleeve and a manually activated locking mechanism, such as a recess configured to receive tie-down screws. In each of these embodiments, the adapter is configured to provide a range of axial movement of the mandrel while mounted within the wellhead assembly. For example, the range of movement may include a sealed position and a pressure release position. Thus, the adapter may enable selective pressure release during a fracturing process, such that additional fluid can flow down hole.

Figure 1:
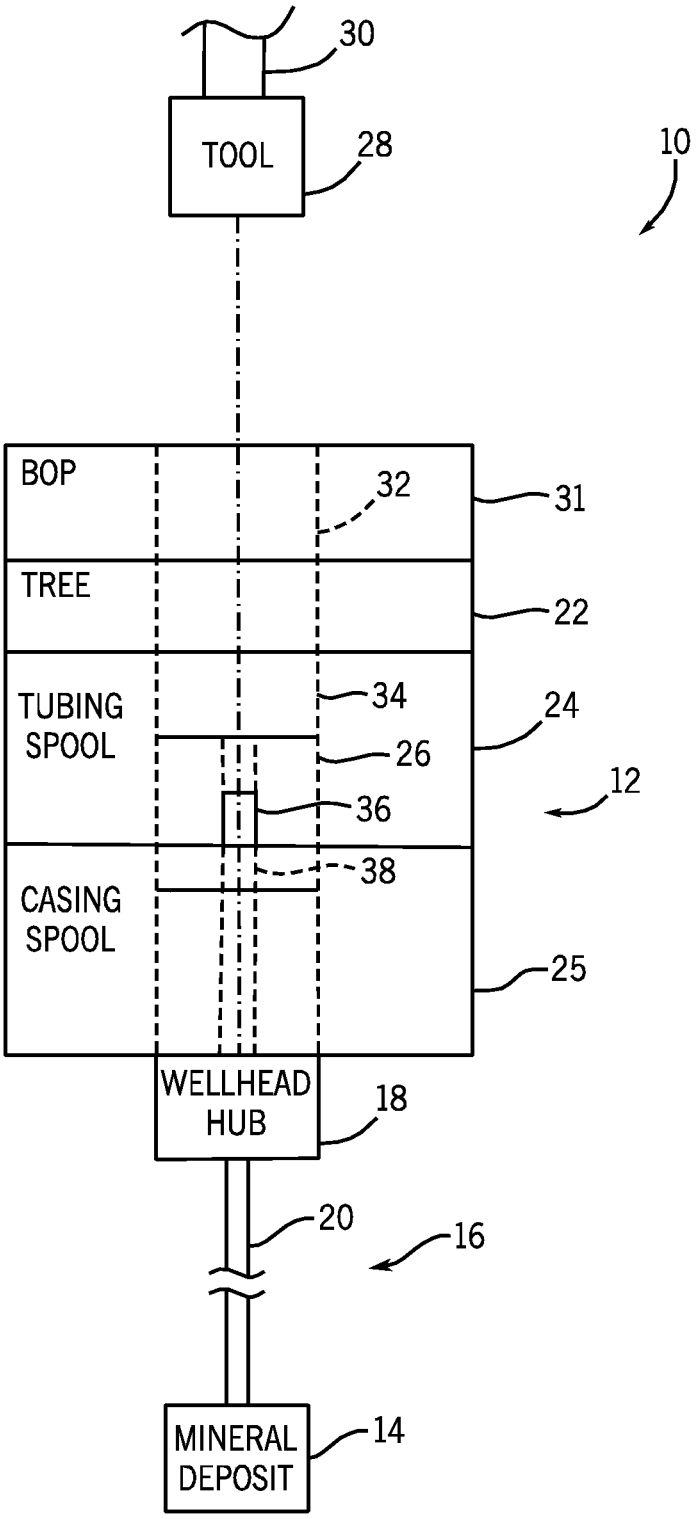
FIG. 1 is a block diagram that illustrates a mineral extraction system in accordance with an embodiment of the present invention.

FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20. The wellhead hub 18 generally includes a large diameter hub that is disposed at the termination of the well-bore 20. The wellhead hub 18 provides for the connection of the wellhead 12 to the well 16.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well-bore 20 (down-hole). In the illustrated embodiment, the wellhead 12 includes what is colloquially referred to as a Christmas tree 22 (hereinafter, a tree), a tubing spool 24, a casing spool 25, and a hanger 26 (e.g., a tubing hanger or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 31 may also be included, either as a part of the tree 22 or as a separate device. The BOP may consist of a variety of valves, fittings and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the tree bore 32 and the well 16. Thus, the tubing spool bore 34 may provide access to the well bore 20 for various completion and worker procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as mandrels, seals, plugs and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20. Pressures in the bores 20 and 34 may manifest through the wellhead 12 if not regulated.

A fracturing mandrel 36, or isolation sleeve, is often seated and locked in the tubing spool 24 to isolate other components of the wellhead from the fracturing pressure. Similar sealing devices may be used throughout mineral extraction systems 10 to regulate fluid pressures and flows. During the fracturing process, the fracturing fluid may be pumped through the mandrel into the well 16. As a result, pressures may become too high to continue pumping fluid into the well 16. In such an instance, it may be desirable to relieve some of the pressure from the well through the tubing spool 24, without removing the mandrel 36, to ensure safe isolation of other wellhead components. Additionally, it is desirable to maintain the blowout preventer 31 to ensure safety of the mineral extraction system during such an operation, yet have the ability to safely manipulate the frac mandrel 36 inside the tubing spool 24.

Figure 2:
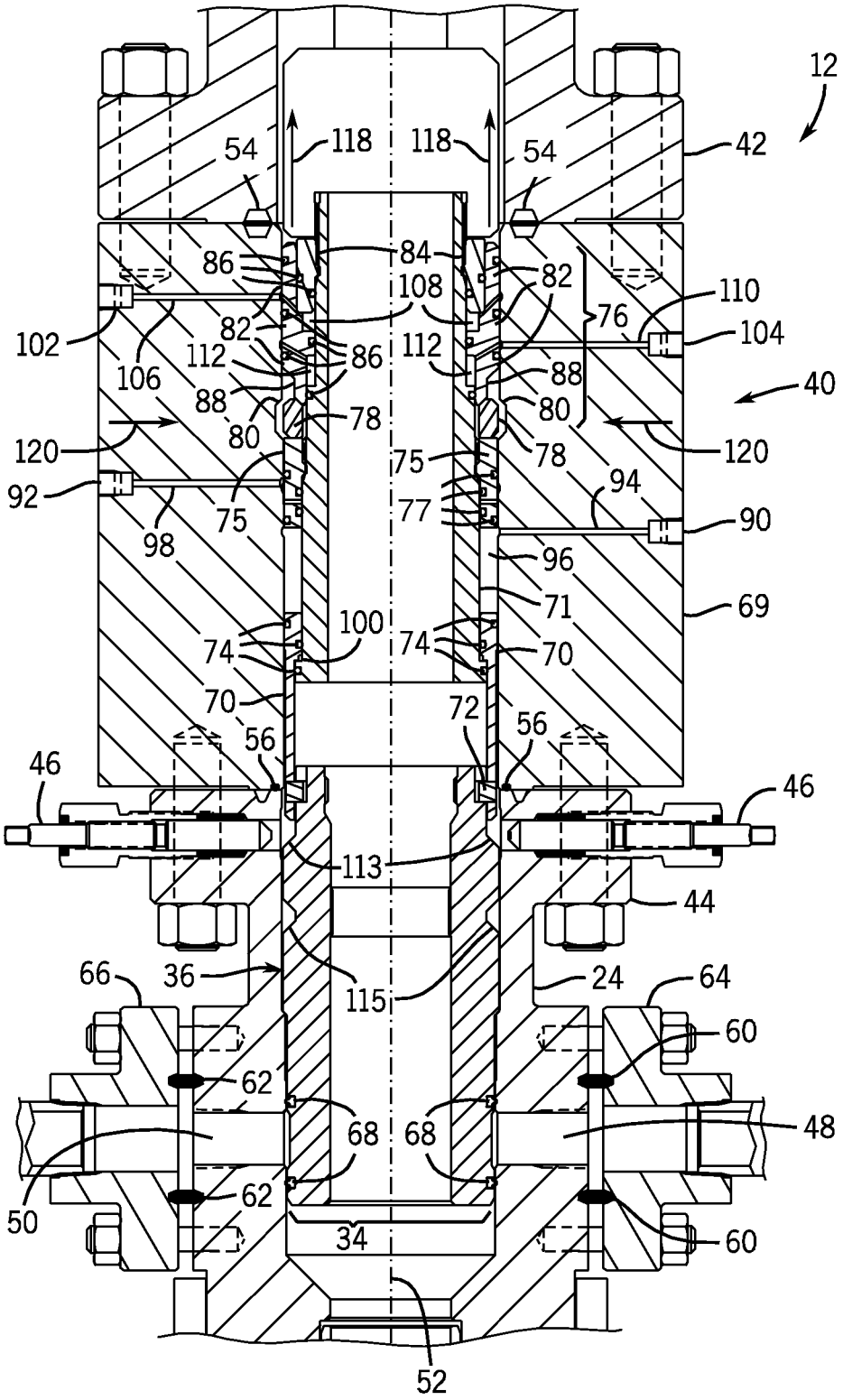
FIG. 2 depicts a cross-section of a wellhead assembly of a mineral extraction system with an unlocked hydraulic adapter in accordance with an embodiment of the present invention.

FIG. 2 depicts a cross-section of the wellhead assembly 12 having a hydraulic adapter 40 in accordance with an embodiment of the present invention. The hydraulic adapter 40 is disposed between the tubing spool 24 and an adapter flange 42. The adapter flange 42 may couple the tubing spool to the blowout preventer 31, the "Christmas" tree 22, or any other components included in the wellhead assembly 12. The tubing spool 24 includes a flange 44, tie-down screws 46, and side passages 48 and 50.

As described above, the tubing spool 24 defines a bore 34 that connects to the casing further down the wellhead assembly 12. In this embodiment, the bore 34 is generally concentric about (or coaxial with) a central axis 52. Annular seals 54 and 56 seal the central passage bore 34, the hydraulic adapter 40, and the tubing spool 24. The side passages 48 and 50 can provide access to the bore 34 and the interior of the tubing spool 24. Generally, annular seals 60 and 62 seal flanges 64 and 66 to the tubing spool 24.

In FIG. 2, the mandrel 36 is shown in a "running position" such that the mandrel 36 is disposed inside the tubing spool 24 to block off the side passages 48 and 50. As mentioned above, during operation of the system 10 it may be desirable to choke off pressure in the wellhead assembly 12. As will be appreciated, the side passages 48 and 50 may be coupled to valves or other fluid-flow components via the flanges 64 and 66, enabling an operator to bleed off pressure. If the mandrel 36 is in the running position, the side passages 48 and 50 are generally blocked by the mandrel 36 and sealed by seals 68.

The adapter 40 includes various components to engage the mandrel 36, to manipulate the mandrel 36, and to lock and seal the adapter 40 to the wellhead assembly 12. The adapter 40 may disposed inside a body 69 coupled to the tubing spool 24 via the flange 44. The adapter 40 includes a moveable sleeve 70 (e.g., annular piston) disposed around a generally tubular interior body 71 and having one or more pins 72 configured to engage a recess on the mandrel 36, as discussed further below. In one embodiment, the pins 72 may engage a generally "J-shaped" recess in the mandrel 36, such that the adapter 40 may be generally inserted and rotated into engagement with the mandrel 36.

The moveable sleeve 70 and/or the body 71 includes one or more seals 74 (e.g., annular seals) to generally seal the sleeve 70 against the tubing spool 24 or other component of the wellhead assembly 12. The adapter 40 also includes a stationary sleeve 75, providing an abutment for the moveable sleeve 70 when in a "retracted" position, as described further below. It should be appreciated that the term "stationary sleeve" refers to movement of the sleeve relative to the fluid-driven movement of the moveable sleeve 70. During assembly or installation, the stationary sleeve 75 may be moved or rotated into the adapter 40. The stationary sleeve 75 also includes one or more seals 77 to generally seal the stationary sleeve 75 against the tubing spool 24.

The adapter 40 also includes an upper segment 76 having a lock ring 78. As described further below, the lock ring 78 may engage a recess 80 on the body of the adapter 40 to lock the adapter 40 to the wellhead assembly 12. The upper segment 76 includes a moveable portion 82 (e.g., annular piston) and a stationary portion 84. It should be appreciated that the term "stationary portion" refers to movement of the portion 84 relative to the fluid-driven movement of the moveable portion 82. During assembly or installation, the stationary portion 84 may be moved or rotated into the adapter 40. The upper segment 76 includes one or more annular seals 86 to seal the portions 82 and 84 against the wellhead assembly 12 and the interior body 71. The moveable portion 82 may include a beveled edge 88 that engages the lock ring 78 when the moveable portion 80 moves, as described further below.

The adapter 40 may include one or more hydraulic ports to provide for the application of hydraulic pressure to move the moveable sleeve 70 and the moveable portion 82. To manipulate the moveable sleeve 70, the adapter 40 may include a first hydraulic port 90 and a second hydraulic port 92. The hydraulic port 90 connects to a first passage 94 extending through the body 69 of the adapter 40 and connecting with a first chamber 96. As illustrated, the first chamber 96 is an annular chamber defined between the stationary sleeve 75 and the moveable sleeve 70. The second hydraulic port 92 connects to a second passage 98 extending through the body 69 of the adapter 40 and connecting with a second chamber 100. The second chamber 100 is an annular chamber defined between the moveable sleeve 70 and the interior body 71.

To manipulate the movable portion 82 of the upper segment 76, the adapter 40 may include a third hydraulic port 102 and a fourth hydraulic port 104. The third hydraulic port 102 connects to a third passage 106 extending through the body 69 of the adapter 40 and connecting with a third chamber 108. The third chamber 108 is an annular chamber defined between the stationary portion 84 and the moveable portion 82 of the upper segment 76. Similarly, the fourth hydraulic port 104 connects to a fourth passage 110 extending through the body 69 of the adapter 40 and connecting with a fourth chamber 112. The fourth chamber 112 is an annular chamber defined between the moveable portion 82 of the upper segment 76 and the interior body 71.

Referring now to both FIGS. 2 and 3, the operation of the lock ring 78 via the third hydraulic port 102 and the fourth hydraulic port 104 will now be described. In FIG. 2, the lock ring 78 is shown in an "unlocked" position. The lock ring 78 is disengaged from the recess 80 of the body 69 of the adapter 40. The lock ring 78 moves in a generally radial direction in response to engagement with the beveled edge 88 of the moveable portion 82. The moveable portion 82 generally moves in an axial direction in response to fluid pressure (e.g., liquid or gas) in the third chamber 108 and the fourth chamber 112.

To move the lock ring 78 to a "locked" position and lock the adapter 40 to the wellhead assembly 12, hydraulic pressure may be applied to the third hydraulic port 102. The third chamber 108 receives pressure from the third hydraulic port 102, generally expanding the chamber 108 and causing the moveable portion 82 to move in a generally axial direction indicated by arrow 114. As shown in FIG. 3, the moveable portion 82 moves until it engages the lock ring 78, pushing the lock ring in a generally radial direction indicated by arrow 116. The lock ring 78 moves in the generally radial direction 116 until it engages the recess 80 of the body of the adapter 40. Once the lock ring 78 is engaged with the recess 80, the adapter 40 is locked against the body 69, preventing axial movement of the adapter 40. As also depicted in FIG. 3, the third hydraulic chamber 108 is shown in an expanded state, as a result of the hydraulic pressure applied to the third hydraulic port 102.

To move the lock ring 78 to an "unlocked" position and unlock the adapter 40, hydraulic pressure may be applied to the fourth hydraulic port 104. The fourth chamber 112 receives pressure from the fourth hydraulic port 108, generally expanding the chamber 112 and causing the moveable portion 82 to move in a generally axial direction indicated by arrow 118. The moveable portion 82 moves axially until it disengages the lock ring 78, removing the force applied by the beveled edge 88 that pushes the lock ring 78 in a generally radial direction. The lock ring 78 moves in the generally radial direction indicated by arrow 120, until it disengages the recess 80 of the body of the adapter 40. As illustrated in FIG. 2, once the lock ring 78 disengages with the recess 80, the adapter 40 is unlocked, e.g., there is no radial force between the adapter 40 and the body, allowing axial movement of the adapter 40. As depicted in FIG. 2, the fourth hydraulic chamber 112 is shown in an expanded state, as a result of the hydraulic pressure applied to the fourth hydraulic port 104.

Figure 3:
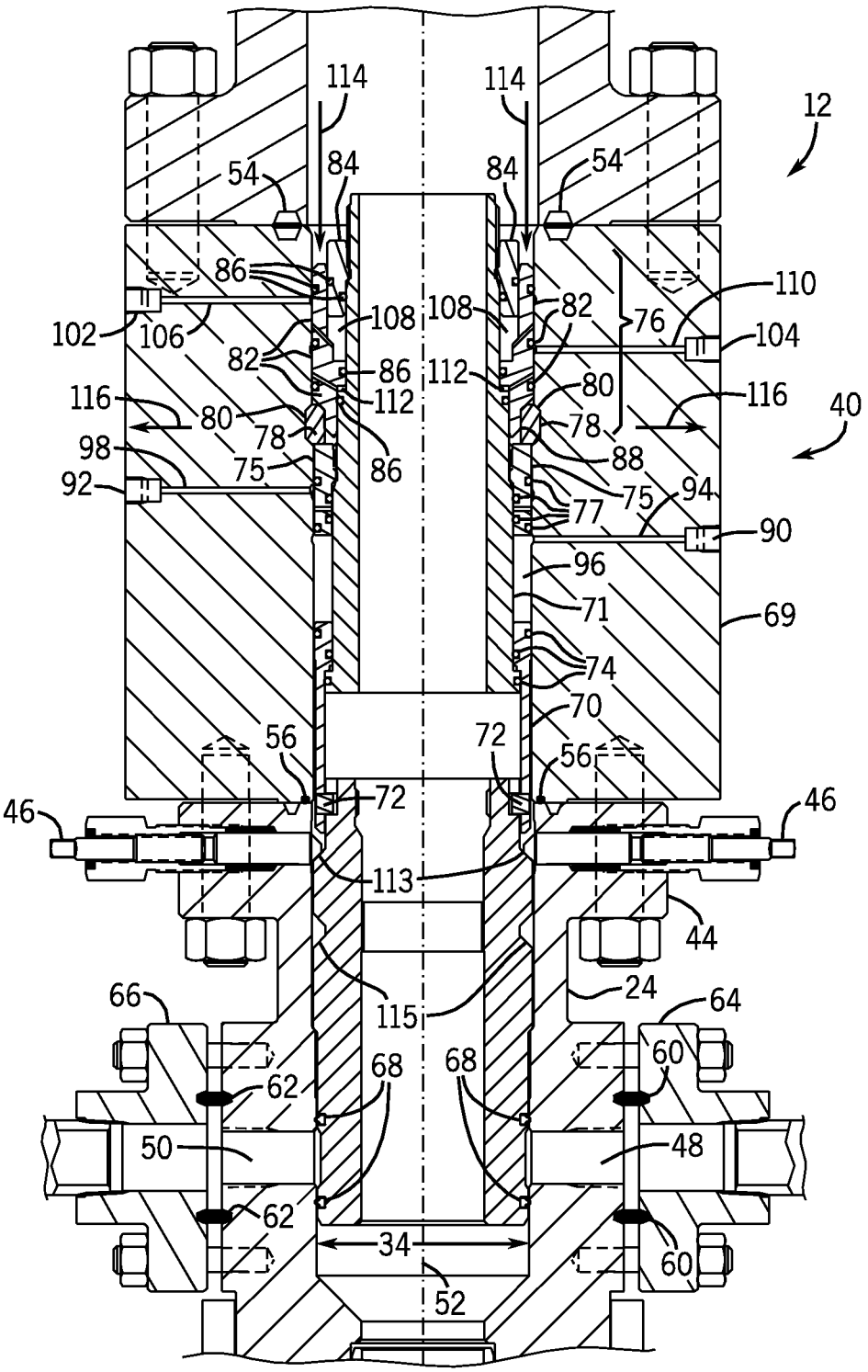
FIG. 3 depicts a cross-section of a wellhead assembly of a mineral extraction system with a locked hydraulic adapter in accordance with an embodiment of the present invention.

As also shown in FIG. 3, to secure the mandrel 36 in the tubing spool 24, the screws 46 may be inserted into recesses 113 of the mandrel 36. The engagement between the screws 46 and the recesses 113 secure the mandrel 36, preventing movement of the mandrel 36 that may be caused by high pressure in the well 16. The tip of the screws 46 and the recesses 113 may be any suitable topography to provide for secure engagement between the screws 46 and the recesses 113.

Figure 4:
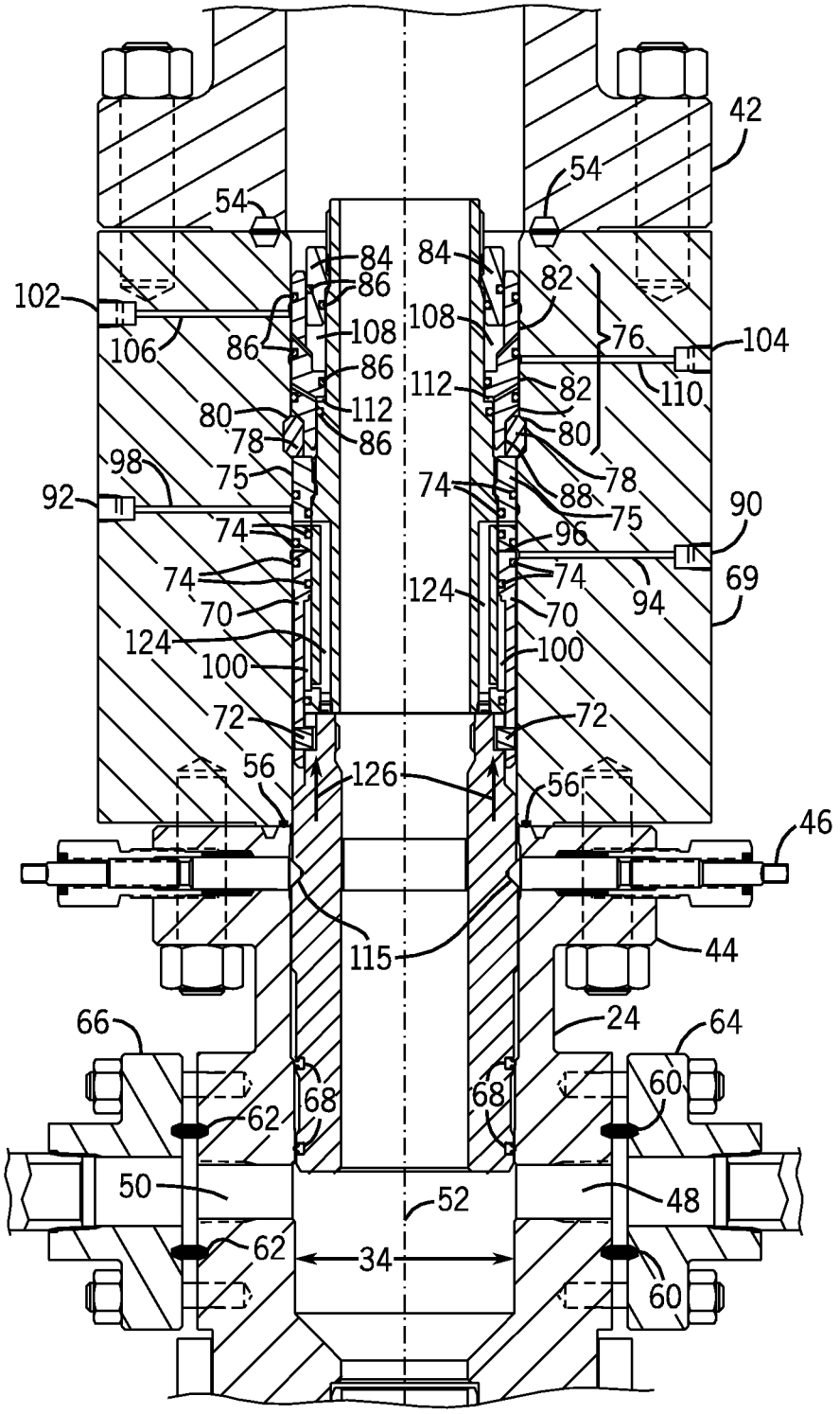
FIG. 4 depicts a cross-section of a wellhead assembly of a mineral extraction system with a hydraulic adapter having a retracted sleeve in accordance with an embodiment of the present invention.
Figure 5:
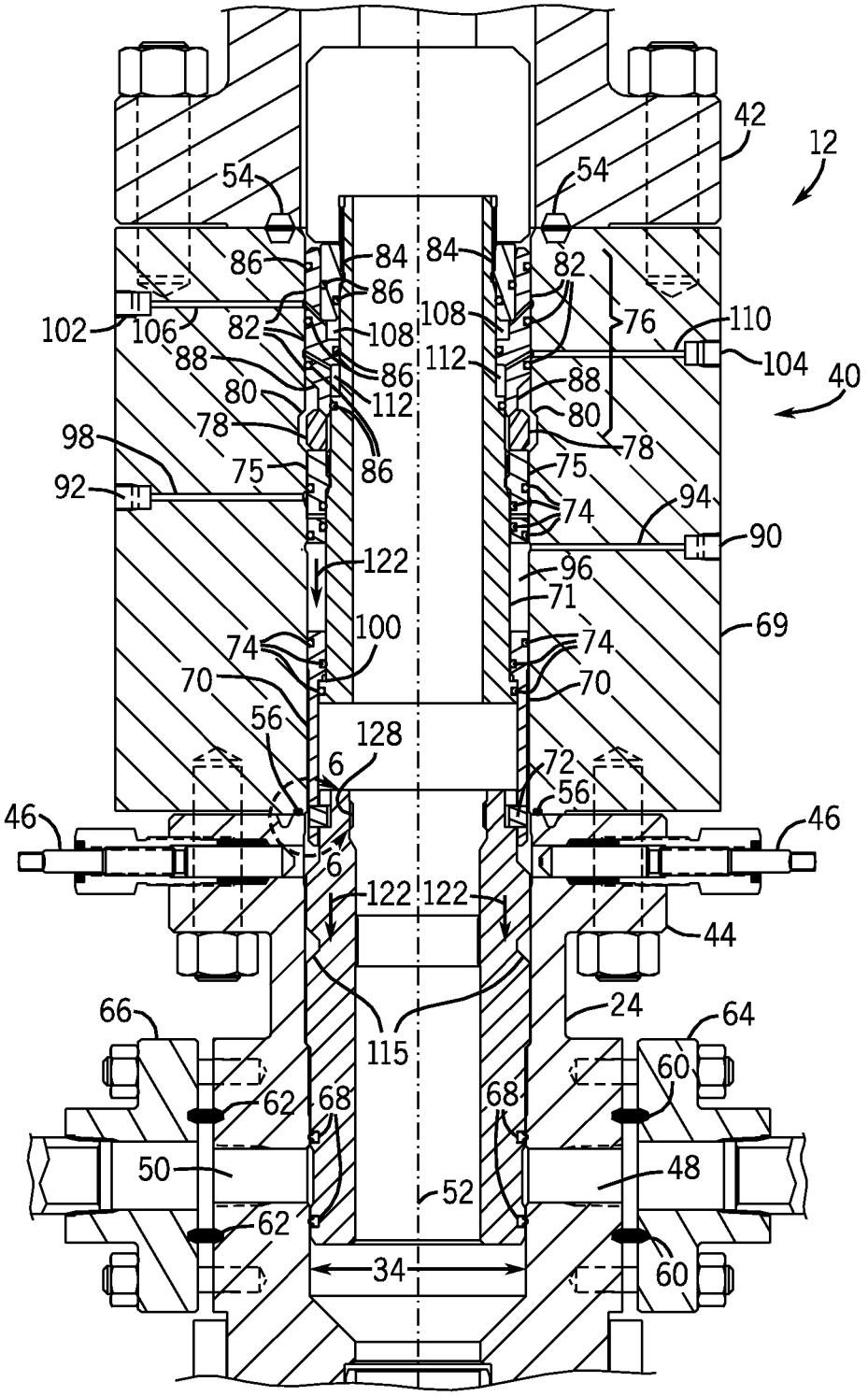
FIG. 5 depicts a cross-section of a wellhead assembly of a mineral extraction system with a hydraulic adapter having an extended sleeve in accordance with an embodiment of the present invention.

FIGS. 4 and 5, depict operation of the moveable sleeve 70 via the first hydraulic port 90 and the second hydraulic port 92. As shown in FIG. 4, the moveable sleeve 70 is in a "retracted" position, such that the mandrel 36 is also retracted and exposing the side passages 48 and 50 to the bore 34 of the tubing spool 24. In an embodiment, to secure the adapter 40 and allow movement of the moveable sleeve 70, the adapter 40 may first be locked into place via hydraulic actuation of the lock ring 78 as described above in FIGS. 2 and 3. As shown in FIG. 5, the moveable sleeve 70 is in an "extended" position, such that the mandrel 36 blocks the side passages 48 and 50. This position may be used when performing the fracturing process, such that high pressure fracturing fluid may be pumped through the mandrel 36 into the well 16.

The moveable sleeve 70 moves in an axial direction in response to fluid pressure (e.g., liquid or gas) applied to the first hydraulic port 90 and the second hydraulic port 92. To move the moveable sleeve 70 from a "retracted" position (FIG. 4) to an "extended" position (FIG. 5), fluid pressure may be applied to the first hydraulic port 90. The first chamber 96 receives pressure from the first hydraulic port 90, generally expanding the chamber 96 and causing axial movement of the moveable sleeve 70 in the direction generally indicated by arrow 122. The connection of the moveable sleeve 70 to the mandrel 36 via the pins 72 translates the axial movement to the mandrel 36, also moving the mandrel 36 in the direction generally indicated by arrow 122. As shown in FIG. 5, the mandrel 36 moves in the axial direction until the mandrel 36 blocks the side passages 48 and 50. As also shown in FIG. 5, the first chamber 96 is in an expanded state in response to the fluid pressure applied through the first hydraulic port 90.

To move the moveable sleeve 70 from the "extended" position (FIG. 5) to a "retracted" position (FIG. 4) and retract the mandrel 36 to open side passages 48 and 50, fluid pressure (e.g., liquid or gas) may be applied to the second hydraulic port 92. As illustrated in FIG. 4, Fluid pressure applied to the second hydraulic port 92 may flow through the second passage 98, through one or more internal passages 124, and into the second chamber 100. The second chamber 100 receives pressure from the second hydraulic port 92, generally expanding the chamber 100 and causing movement of the moveable sleeve 70 in an axial direction generally indicated by the arrow 126 (see FIG. 4). The moveable sleeve 70 moves in an axial direction until abutting the stationary sleeve 75. The expanded second chamber 100 is also illustrated in FIG. 4. The connection to the mandrel 36 provided by the pins of the sleeve 70 results in the mandrel 36 also moving in the axial direction generally indicated by arrow 126. In this "retracted position," the mandrel 36 provides access to the side passages 48 and 50, enables pressure to be released through the side passages 48 and 50. Advantageously, the lock ring 78 provides a safe and secure locking mechanism to protect the adapter 40 and mandrel 36 from axial movement during operation of the sleeve 70 and mandrel 36. Additionally, as also shown in FIG. 4, the screws 46 may engage recesses 115 of the mandrel 36. The recesses 115 allow the mandrel 36 to be secured in the retracted position, preventing axial movement of the mandrel 36 as a result of any high pressure conditions in the well 16. The tip of the screws 46 and the recesses 115 may be any suitable topography to provide for secure engagement between the screws 46 and the recesses 115.

FIG. 6 depicts a close-up view of a section 128 of FIG. 5 along line 6-6 in accordance with an embodiment of the present invention. The close-up view of FIG. 6 further illustrates the engagement of the sleeve 70 with the mandrel 36. As shown in FIG. 6, the pins 72 engage a recess 130 on the mandrel 36. To secure the engagement, the pins 72 may be generally inserted and moved to lock the sleeve 70, and thus the adapter 40, to the mandrel 36.

FIG. 7 is a cross section of the recess 130 taken along line 7-7 of FIG. 6. As illustrated in one embodiment, the recess 130 may be a generally "J-shaped" recess having an opening 132 and an inner cavity 134. To engage the adapter 40 with the mandrel 36, the pins 72 may be inserted axially into the opening 132 of the recess 130 as indicated by arrows 131, rotated along the J-shape as indicated by arrow 133, and moved axially into the inner cavity 134 as indicated by arrow 135. To remove the adapter 40 from the mandrel 36, the pins 72 may be generally moved from the inner cavity 134 to the opening 132, and then out through the opening 132 in a reverse series of movements. As mentioned above, the adapter 40 may be engaged with the mandrel 36 prior to the insertion of the mandrel 36 into the wellhead assembly 12, or may be engaged to the mandrel 36 after the mandrel 36 is already inserted in the wellhead assembly 12.

Figure 8:
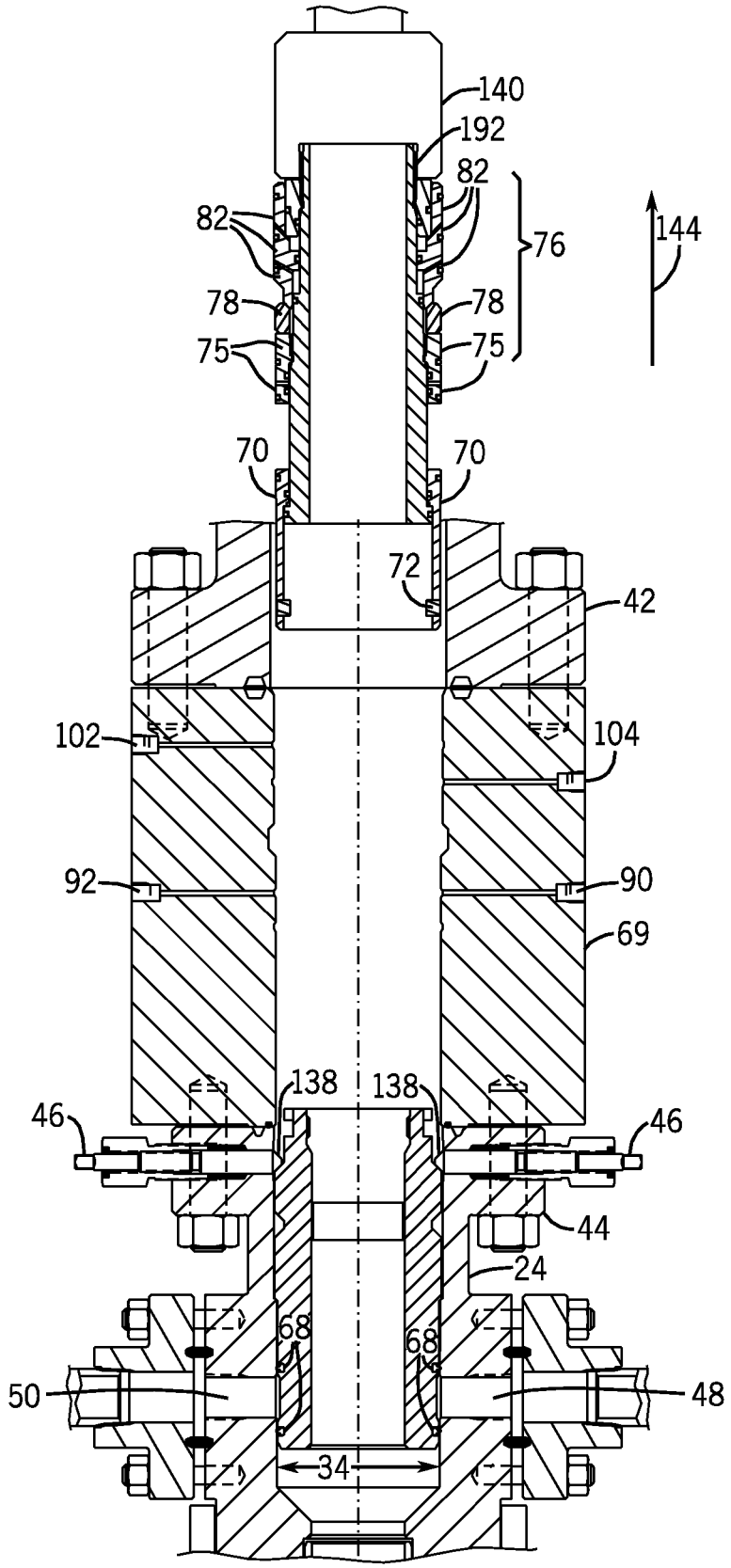
FIG. 8 is a cross-section of a wellhead assembly of a mineral extraction system depicting removal of a hydraulic adapter in accordance with an embodiment of the present invention.

FIG. 8 illustrates removal of the adapter 40 in accordance with an embodiment of the present invention. To remove the adapter 40, the mandrel 36 may be first moved to from the "retracted" position to the "extended" position, as described above in FIGS. 4 and 5, such that the mandrel 36 blocks the side passages 48 and 50. To secure the mandrel 36, the tie-down screws 46 may be inserted through the tubing spool 24 to engage a beveled edge 138 of the mandrel 36. The tie-down screws 46 ensure the mandrel 36 is secure before unlocking the adapter 40.

To remove the adapter 40, the lock ring 78 is retracted via pressure applied to the fourth hydraulic port 104 as described above in FIGS. 2 and 3. To disengage the adapter 40 from the mandrel 36, the adapter 40 may be moved such that the pins 72 disengage from the recess 130, as described above in FIGS. 6 and 7. The adapter 40 may be retrieved via a tool 140 inserted through the wellhead assembly 12 to grab the top 142 of the adapter 40. The adapter 40 may then be removed from the wellhead assembly 12 by removing the adapter 40 in the axial direction generally indicated by arrow 144.

Figure 9:
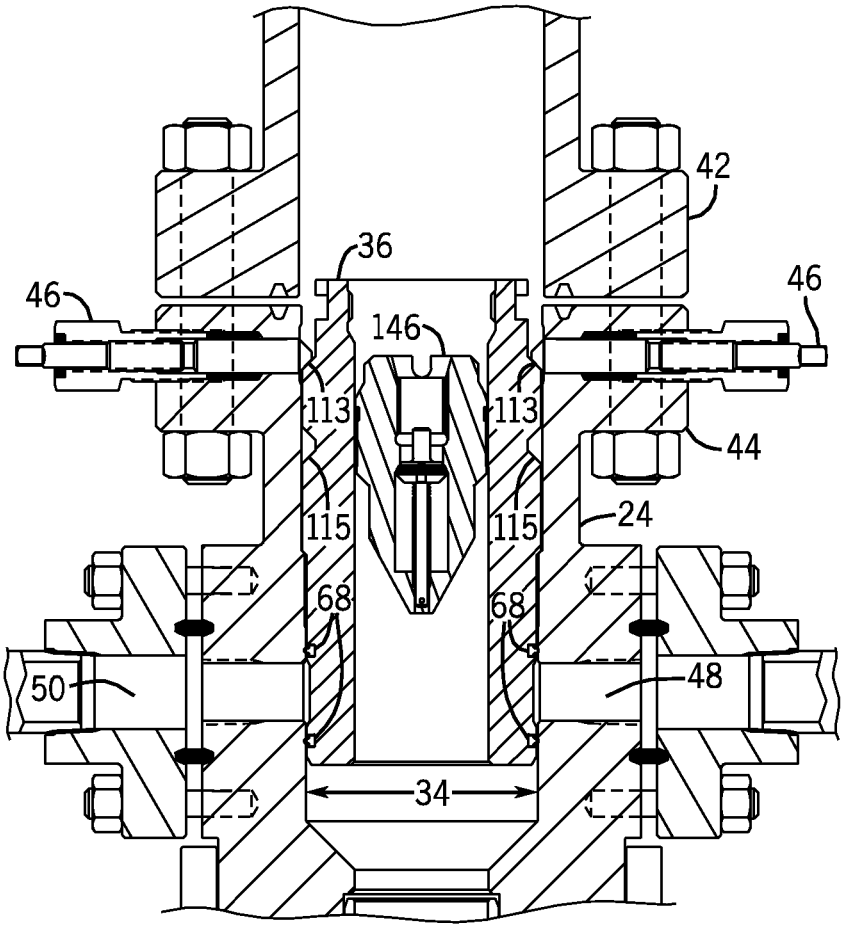
FIG. 9 depicts a cross-section of a wellhead assembly of a mineral extraction system having a backpressure valve in accordance with an embodiment of the present invention.

FIG. 9 illustrates operation of the mandrel 36 with a backpressure valve 146 (BPV) in accordance with an embodiment of the present invention. During the operation of the components of the wellhead assembly 12, such as the operation of the mandrel 36 or the adapter 40, a backpressure valve 146 may be inserted into the mandrel 36. The backpressure valve 146 may be inserted through the adapter 40 into the mandrel 36, or may be inserted into the mandrel 36 after removal of the adapter 40, or the adapter 40 and the body 69. The backpressure valve 146 provides additional protection against pressure in the well 16, allowing safe removal of the adapter flange 42 and/or any components coupled to the tubing spool 24 via the flange 42, such as the BOP 31, the tree 22, etc.

Figure 10:
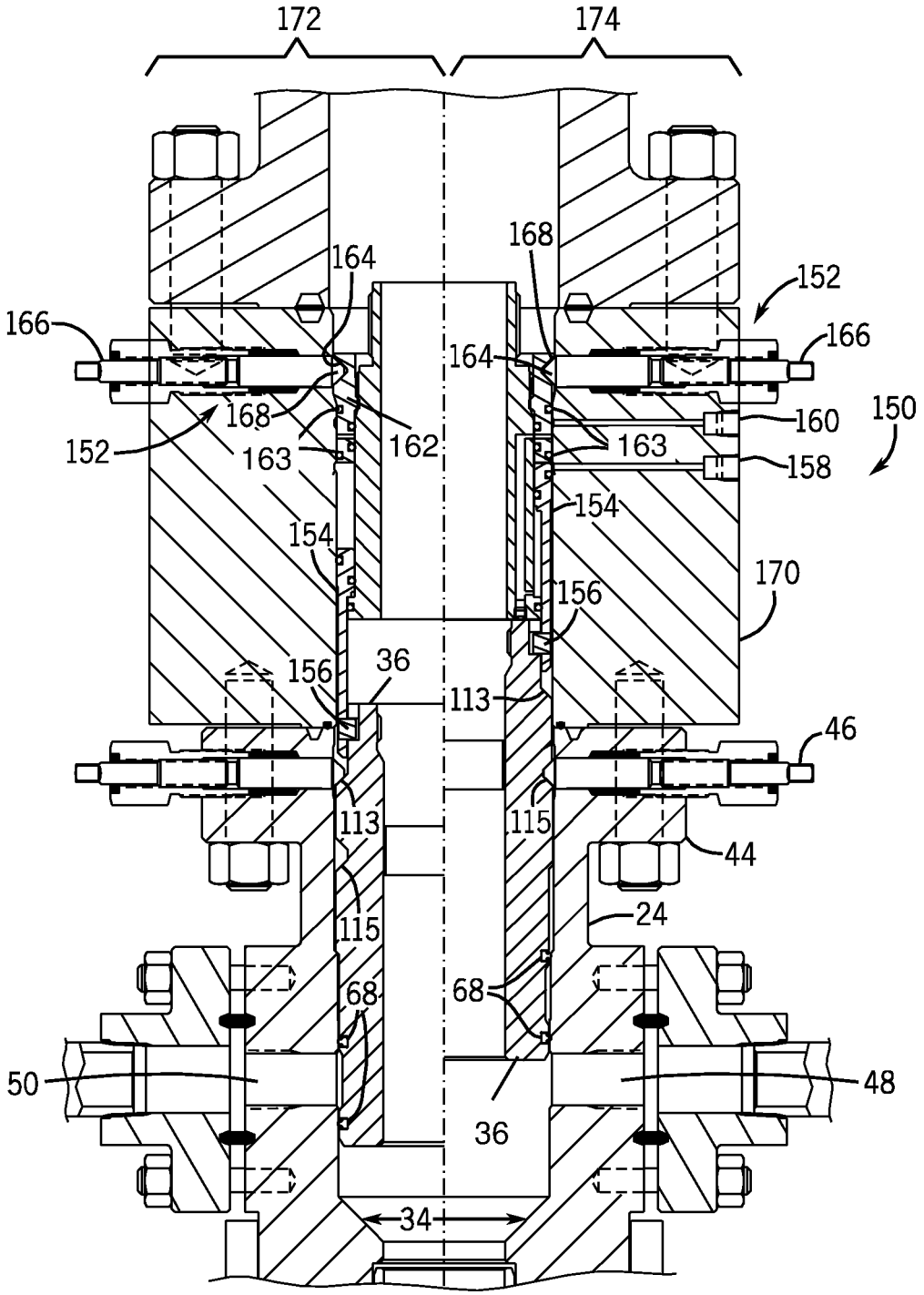
FIG. 10 depicts a cross-section of a wellhead assembly of a mineral extraction system having a hydraulic adapter with a manual locking mechanism in accordance with an embodiment of the present invention.

FIG. 10 illustrates an adapter 150 having a manual locking mechanism 152 in accordance with an embodiment of the present invention. The adapter 150 is substantially the same as the previous embodiment illustrated above in FIGS. 2-8 except for the manual locking mechanism 152. The left hand side of FIG. 10 depicts the mandrel 36 in an "extended" position, and the right hand side of FIG. 10 depicts the mandrel 36 in a "retracted" position. As shown in the FIG. 10, the adapter 150 includes a moveable sleeve 154 that engages the mandrel 36 via one or pins 156, as described above. Further, the moveable sleeve 154 may be moved via a first hydraulic port 158 and a second hydraulic port 160 in a manner similar to embodiment described above in FIGS. 4 and 5. In contrast to the embodiment described above, a stationary sleeve 162 (with seals 163) of the adapter 40 includes one or more recesses 164 configured to receive one or more tie-down screws 166. For example, in an embodiment, the recesses 164 may be beveled, chamfered or have any other topography to facilitate engagement the similarly topographied edge 168 of the tie-down screws 166.

To lock the adapter 150 in place via the manual locking mechanism 152, the tie-down screws 166 may be inserted into a body 170 of the adapter 40 to engage the recesses 164. As shown in the left hand side 172 of FIG. 10, the moveable sleeve 154 may be moved to an extended position via the first hydraulic port 158, and the engagement of the screws 166 with the stationary sleeve 162 locks the adapter 150 to the wellhead assembly 12 to prevent axial movement of the adapter 150 during movement of the sleeve 154. As also described above, the mandrel 36 may be secured by engagement of the screws 46 with the recesses 113.

Similarly, as shown in the right hand side 174 of FIG. 10, the sleeve 154 of the adapter 150 may be moved to a "retracted" position via the second hydraulic port 160, retracting the mandrel 36 and exposing the side passages 48 and 50. Again, the engagement of the tie-down screws 166 of the manual locking mechanism 152 prevents movement of the adapter 150 during movement of the sleeve 156 or exposure of the mandrel 36 or bore 34 of the tubing spool 24 to high pressure conditions. As also described above, the mandrel may be secured against pressure in the well 16 by engagement of the screws 46 with the recesses 115. To remove the adapter 150, the tie-down screws 166 may be retracted from engagement with the stationary sleeve 162 so that the stationary sleeve 162 of the adapter 150 is free to move in an axial direction. The adapter 150 may removed in the manner described above in FIG. 8.

Figure 11:
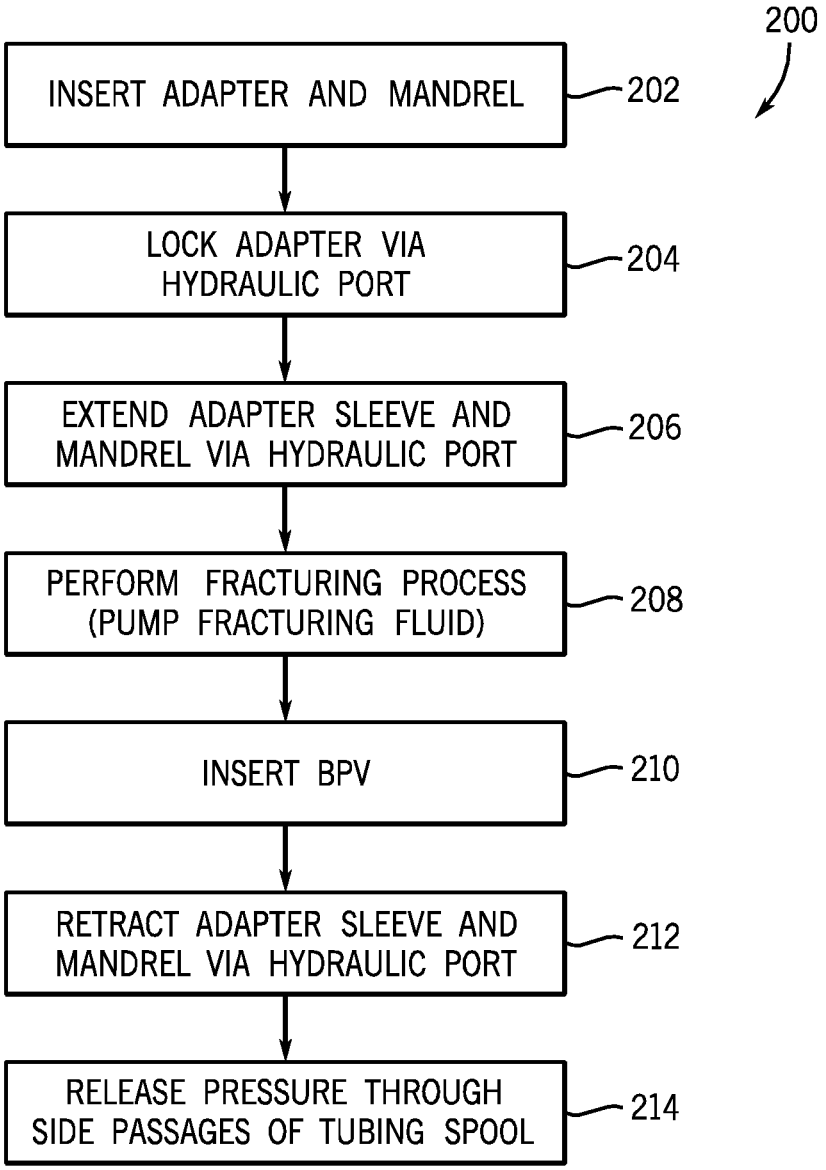
FIG. 11 is a block diagram of a process for operation a hydraulic adapter in a mineral extraction system in accordance with an embodiment of the present invention.

FIG. 11 depicts an embodiment of a process 200 for operating a wellhead assembly 12 that includes the adapter 40 and mandrel 36 in accordance with an embodiment of the present invention. During operation of the wellhead assembly 12, the adapter 40 and mandrel 36 may be inserted into the assembly 12 (block 202), such as into the tubing spool 24. The mandrel 46 and adapter 40 may be preassembled before insertion into the wellhead assembly 12, or the adapter 40 and mandrel 36 may be inserted separately. The adapter 40 may be locked by applying pressure to the third hydraulic port 102 and engaging the lock ring 78 (block 204). Alternatively, in some embodiments, an adapter 150 may be locked through manual insertion of tie-down screws 166 as described above in FIG. 10.

After the adapter 40 is locked, the moveable sleeve 70 of the adapter 40 may be extended via the first hydraulic port 90 (block 206). As described above, extending the moveable sleeve 70 also extends the mandrel 36, blocking the side passages 48 and 50. As discussed above, the mandrel 36 may be secured via the screws 46 and the recesses 113 The fracturing process may then be performed by pumping fracturing fluid through the mandrel 36 (block 208), resulting in increased pressures in the well 16.

To prevent backpressure up through the wellhead assembly 12, a backpressure valve 146 may be inserted through the adapter 40 into the mandrel 36 (block 210). As described above, after the fracturing process it may be desirable to release some of the pressure from the well 16 so that fracturing fluid may continue to be pumped into the well 16 through the mandrel 36. To allow access to the side passages 48 and 50, the moveable sleeve 70 of the adapter 40 may be retracted via the fourth hydraulic port 92 (block 212), retracting the mandrel 36. As discussed above, the mandrel 36 may be secured via the screws 46 and the recesses 115. With the mandrel 36 in a retracted position, the side passages 48 and 50 of the tubing spool 24 are accessible to the bore 34 of the tubing spool 24. The pressure inside the well 16 may be released through operation of valves or other equipment coupled to the side passages 48 and 50 (block 214).

As described above, the disclosed embodiments enable fluid pressure controlled movement of mandrel 36 along a limited range while generally mounted in the tubing spool 24, thereby enabling remote control of side passages 48 and 50 to selectively relieve pressure. In some embodiments, the moveable components of the adapter 40 or 150, such as the moveable sleeve 70 and the moveable portion 82, may be fluid-driven pistons. Additionally, any of the components of the adapter 40 or 150 may secured to the adapter 40 or 150 by any suitable mechanism, such as threads, adhesives, lock rings, etc.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

an adapter configured to couple to a wellhead assembly, wherein the adapter comprises:

a body having a bore;

a tubular body disposed in the bore of the body;

a first piston disposed between an inner surface of the bore and an outer surface of the tubular body, wherein the first piston is configured to couple with an isolation sleeve via a coupling;

a first fluid chamber disposed between the inner surface of the bore and the outer surface of the tubular body, wherein the first fluid chamber is configured to receive a first fluid pressure to drive the first piston in a first axial direction to drive the isolation sleeve between open and closed positions relative to one or more passages in the wellhead assembly; and a second fluid chamber disposed between a first inner surface of the first piston and the outer surface of the tubular body, wherein the second fluid chamber is configured to receive a second fluid pressure to drive the first piston in a second axial direction opposite the first axial direction to drive the isolation sleeve between the open and closed positions relative to the one or more passages in the wellhead assembly.

2. The system of claim 1, comprising the isolation sleeve coupled to the first piston via the coupling.

3. The system of claim 2, wherein the isolation sleeve comprises one or more seals disposed along an exterior surface of the isolation sleeve, wherein, in the closed position of the isolation sleeve, the exterior surface is configured to directly cover the one or more passages and the one or more seals are configured to directly seal against an interior surface of the wellhead assembly to seal the one or more passages.

4. The system of claim 1, wherein the coupling comprises first and second coupling portions configured to engage one another sequentially along an axial path of travel and a rotational path of travel relative to an axis of the bore.

5. The system of claim 1, wherein the coupling comprises a J-shaped coupling portion.

6. The system of claim 1, wherein the first piston comprises an annular piston disposed circumferentially about the outer surface of the tubular body.

7. The system of claim 6, wherein the first piston comprises a first portion extending radially inward relative to an axis of the bore, the tubular body comprises a second portion extending radially outward relative to the axis of the bore, and the second fluid chamber is disposed between the first and second portions.

8. The system of claim 7, comprising a first seal disposed between the inner surface of the bore and a first outer surface of the first piston, a second seal disposed between the outer surface of the tubular body and the first inner surface of the first piston at the first portion, and a third seal disposed between the outer surface of the tubular body and the first inner surface of the first piston, wherein the second and third seals are disposed on axially opposite sides of the second fluid chamber.

9. The system of claim 6, comprising a stationary sleeve disposed between the inner surface of the bore and the outer surface of the tubular body, wherein the first fluid chamber is disposed axially between the stationary sleeve and the first piston.

10. The system of claim 9, wherein the stationary sleeve comprises a fluid passage extending through the stationary sleeve between the inner surface of the bore and the outer surface of the tubular body, and the fluid passage is configured to fluidly couple with a fluid port in the body.

11. The system of claim 10, wherein the first piston comprises an internal fluid passage extending through a wall of the first piston between the fluid passage in the stationary sleeve and the second fluid chamber.

12. The system of claim 1, wherein the first piston comprises an internal fluid passage extending through a wall of the first piston.

13. The system of claim 12, wherein the internal fluid passage is configured to fluidly couple with a fluid port in the body and the second fluid chamber.

14. The system of claim 1, comprising an internal lock disposed between the inner surface of the bore and the outer surface of the tubular body.

15. The system of claim 14, comprising a second piston disposed between the inner surface of the bore and the outer surface of the tubular body, wherein the second piston is configured to move the internal lock between an unlocked position and a locked position between the body and the tubular body in response to fluid pressure.

16. The system of claim 15, wherein the second piston comprises an annular piston disposed circumferentially about the outer surface of the tubular body.

17. The system of claim 15, comprising a third fluid chamber disposed between a second inner surface of the second piston and the outer surface of the tubular body, and a first internal fluid passage through the second piston to the third fluid chamber.

18. The system of claim 17, comprising a fourth fluid chamber disposed between the second inner surface of the second piston and the outer surface of the tubular body, and a second internal fluid passage through the second piston to the fourth fluid chamber.

19. A system, comprising:

an adapter configured to couple to a wellhead assembly, wherein the adapter comprises:

a body having a bore;

a tubular body disposed in the bore of the body;

a piston disposed between an inner surface of the bore and an outer surface of the tubular body, wherein the piston comprises an internal fluid passage through a wall of the piston;

a first fluid chamber adjacent the first piston, wherein the first fluid chamber is configured to receive a first fluid pressure to drive the first piston in a first axial direction to drive a component between first and second positions; and a second fluid chamber adjacent the first piston, wherein the second fluid chamber is configured to receive a second fluid pressure to drive the first piston in a second axial direction opposite the first axial direction to drive the component between the first and second positions;

wherein the internal fluid passage is fluidly coupled to one of the first or second fluid chambers;

wherein the component comprises an isolation sleeve configured to open and close one or more passages in the wellhead assembly.

20. A system, comprising:

an adapter configured to couple to a wellhead assembly, wherein the adapter comprises:

a body having a bore;

a tubular body disposed in the bore of the body;

a first piston disposed between an inner surface of the bore and an outer surface of the tubular body, wherein the first piston comprises a first internal fluid passage through a first wall of the first piston to a first fluid chamber, and the first piston is configured to move an isolation sleeve between open and closed positions relative to one or more passages in the wellhead assembly in response to fluid pressure in the first fluid chamber; and a second piston disposed between the inner surface of the bore and the outer surface of the tubular body, wherein the second piston comprises a second internal fluid passage through a second wall of the second piston to a second fluid chamber, and the second piston is configured to move an internal lock between unlocked and locked positions between the body and the tubular body in response to fluid pressure in the second fluid chamber.

* * * * *